US006192583B1

(12) United States Patent
Roffelsen

(10) Patent No.: US 6,192,583 B1
(45) Date of Patent: Feb. 27, 2001

(54) HEAT EXCHANGER TUBE AND METHOD OF MANUFACTURING SAME

(75) Inventor: Franciscus Roffelsen, Helmond (NL)

(73) Assignee: Spiro Research B.V. (NL)

( * ) Notice: Subject to any disclaimer, the term of this patent is extended or adjusted under 35 U.S.C. 154(b) by 0 days.

(21) Appl. No.: 09/308,481

(22) PCT Filed: Nov. 24, 1997

(86) PCT No.: PCT/NL97/00640

§ 371 Date: May 17, 1999

§ 102(e) Date: May 17, 1999

(87) PCT Pub. No.: WO98/22769

PCT Pub. Date: May 28, 1998

(30) Foreign Application Priority Data

Nov. 22, 1996 (NL) ..... 1004592

(51) Int. Cl.[7] ..... F28F 11/00

(52) U.S. Cl. ..... 29/890.036; 165/70; 138/114

(58) Field of Search ..... 165/70, 82, 154, 165/180; 138/104, 114; 29/890.036

(56) References Cited

U.S. PATENT DOCUMENTS

| | | | | |
|---|---|---|---|---|
| 3,506,039 | * | 4/1970 | Marriott | 138/114 |
| 4,337,824 | * | 7/1982 | Kirk | 165/70 |
| 4,372,374 | * | 2/1983 | Lee | 165/70 |
| 4,858,681 | * | 8/1989 | Sulzberger | 165/70 |

FOREIGN PATENT DOCUMENTS

| | | | | |
|---|---|---|---|---|
| 2931606 | * | 2/1981 | (DE) | 165/70 |
| 52522 | * | 5/1982 | (EP) | 165/70 |
| 741113 | * | 2/1933 | (FR) | 29/890.036 |

* cited by examiner

*Primary Examiner*—Leonard Leo
(74) *Attorney, Agent, or Firm*—Varnum, Riddering, Schmidt & Howlett LLP

(57) ABSTRACT

A heat exchanger tube is composed of a metal outer tube having an inner profile and a metal inner tube having an outer profile, wherein the profiles are in an undercut engagement with each other so that the inner and outer tubes are in rigid abutment and at least one longitudinal channel, formed between the outer tube and the inner tube is provided for leak detection and the heat exchanger tube may be manufactured by designing the profile so that the inner and outer tubes may be screwed or slid into one another to provide a rigidly abutting configuration.

16 Claims, 1 Drawing Sheet

HEAT EXCHANGER TUBE AND METHOD OF MANUFACTURING SAME

BACKGROUND OF THE INVENTION

1. Field of the Invention

The invention relates to a heat exchanger tube for transferring heat from a flowing medium to another flowing medium, which tube is composed of a metal outer tube and a metal inner tube, whose facing surfaces are provided with substantially complementary profiles and rigidly abut against each other to form at least one longitudinal channel for leak detection extending between the outer tube and the inner tube. The invention also relates to a method of manufacturing such heat exchanger tube.

2. Background Art

Such heat exchanger tube is known from GB-A-2 109 913. The outer and inner tubes which together form the double-walled heat exchanger tube are fed as smooth tubes to a deforming apparatus, which initially reduces the tubes in diameter, with fins being formed on the outer tube. At the end of the deforming process, the parts of the outer tube located between the fins, together with corresponding parts of the inner tube, are pressed inwards, so that a corrugated, double-walled tube is created, with a leak-detection channel remaining each time between two inwardly pressed corrugated parts of the double-walled tube.

However, this heat exchanger tube does not guarantee that in the case of substantial temperature differences and fluctuations between the media on either side of the double-walled heat exchanger tube or in one of the media, the facial contact between the inner and the outer tube, which is to provide the desired, proper heat transfer, is maintained in the manner required. Tests have shown that as a consequence of the expansion and/or shrinking movements of the inner and/or outer tube, a slowly progressing splitting occurs between the two tubes, which gradually reduces the heat transfer capacity to a minimum.

SUMMARY OF THE INVENTION

The object of the invention is to provide a heat exchanger tube of the type described in the opening paragraph, wherein the above problems no longer occur.

To that end, the heat exchanger tube according to the invention is characterized in that the profiles are in undercut engagement in such a manner that when the inner tube shrinks relative to the outer tube and/or the outer tube expands relative to the inner tube, the parts which are in undercut engagement are pulled against each other more firmly.

By virtue of the features of the invention, a heat exchanger tube is obtained which can be manufactured in a relatively simple and inexpensive manner and which, because of the facial contact which is yet intensified during temperature deformations, also remains functioning optimally during the occurrence of relatively substantial temperature fluctuations and alternations.

In this regard, a longitudinal channel can be formed by providing grooves on or in the profiles. According to a preferred embodiment of the invention, however, longitudinal channels for leak detection can be provided in a particularly easy manner if at least the profile of the inner or outer tube has its free edge portion rounded or bevelled. In this manner, a number of circumferentially distributed longitudinal channels can be readily formed, which can be coupled in a known manner to leak detectors or sensors.

If, according to a further embodiment of the invention, the profiles of the outer and inner tubes, in cross section, have a continuously widening shape in the direction of the free end, the engaging surfaces of the outer and inner tubes can be brought into and held in a close and firm contact, which contact is additionally intensified during temperature fluctuations owing to wedge-like clamping action. Such construction can be realized in a relatively simple manner when the profiles of the outer and/or inner tube in cross section have the shape of an isosceles trapezium, so that, during shrinking of the inner tube and/or expansion of the outer tube, the profiles are pulled into firmer contact on account of their interlocking dovetail forms, as a result of which an optimum abutment, and hence a proper heat transfer, is and remains guaranteed.

A preferred embodiment is obtained when the profiles of the outer and inner tubes are provided in the form of screw threads, the arrangement being such that the profiles of the inner and outer tubes can be brought into screw thread engagement with each other. In another particularly advantageous embodiment, the profiles of the outer and inner tubes are designed as longitudinally extending ribs, the arrangement being such that the profiles of the inner and outer tubes can engage with each other as longitudinal teeth.

The invention also provides a method of manufacturing such heat exchanger tube, wherein the inner tube and the outer tube are provided with the desired profiles, the inner tube is inserted into the outer tube and the thus assembled tubes can undergo, in a drawing process through cold deformation, such a change in diameter that the profiled outer wall of the inner tube is omnilaterally and without play clamped against the profiled inner wall of the outer tube. Owing to this method, the manufacture of the inner and outer tubes can take place with relatively wide tolerances, so that the tubes are easy to assemble, while after deformation, the inner and outer tubes act as a single tube which is resistant to strong temperature fluctuations and alternations and which always guarantees an optimum heat transfer. By means of for instance a drawing die, the inner diameter of the outer tube can be reduced and/or the outer diameter of the inner tube can be increased during the drawing process, to arrive at an assembly which functions as one whole.

In this regard, the inner and outer tubes can be assembled in a particularly easy manner if those tubes are designed so that the inner tube can be inserted into the outer tube through screwing or sliding.

Hereinafter, the invention will be specified on the basis of two exemplary embodiments of a heat exchanger tube according to the invention, with reference to the accompanying drawing.

DETAILED DESCRIPTION

Figure 1:
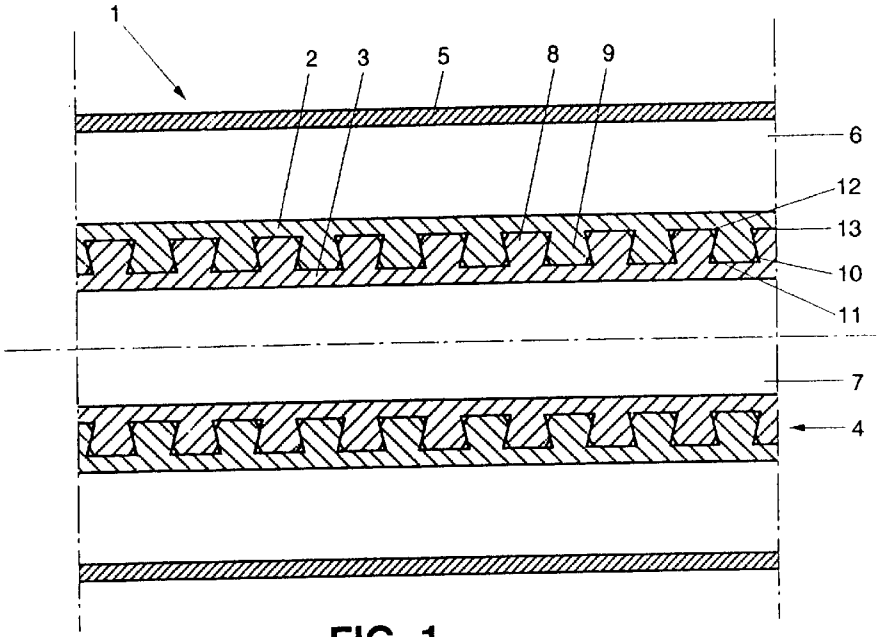
FIG. 1 shows a first embodiment in longitudinal section.

FIG. 1 shows, in longitudinal section, a heat exchanger 1, formed by a heat exchanger tube 4 consisting of two tubes 2, 3 and an element provided therearound, for instance a third tube 5. The heat exchanger tube 4 keeps a space 6 for a first medium separated from a space 7 for a second medium. The outer tube 2 and the inner tube 3 of the heat exchanger tube 4 have, on their facing surfaces, a screw thread-shaped profile 8 and 9 respectively, which profiles interlock.

In cross section, the screw thread-shaped profiles 8, 9 have the shape of an isosceles, inverted trapezium, which is preferred in particular if the temperature differences between one medium in the space 6 and the other medium in the space 7 or in a medium itself are substantial. The dovetail-shaped engagement of the screw thread-shaped profiles 8, 9 prevents the so-called "splitting apart" of the two tubes 2, 3 which constitute the heat exchanger tube 4, with expansion of the outer tube 2 and/or shrinkage of the inner tube 3 resulting in the flanks of the profiles 8 and 9 pressing against each other more firmly.

The free edge portions of the screw thread-shaped profiles 8 and 9 are bevelled to provide four spiral-shaped channels 10, 11 and 12, 13 respectively, which extend in longitudinal direction of the heat exchanger tube 4 and can be used in a known manner for leak detection. However, it is also possible to bevel the edge portions of one profile 8 or 9 only, which results in two longitudinal channels 10, 11 or 12, 13.

Figure 2:
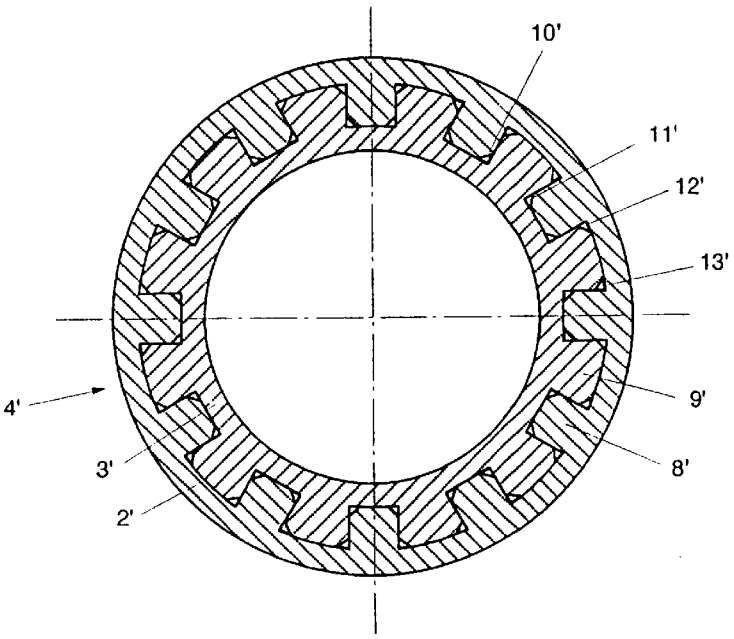
FIG. 2 shows a second embodiment in cross section.

FIG. 2 shows, in cross section, a heat exchanger tube 4' consisting of an outer tube 2' having an inner profile 8' and an inner tube 3' having an outer profile 9'. The profiles 8', 9' consist of longitudinally extending ribs which interlock as longitudinal teeth. In this exemplary embodiment, too, the free edges of the profiles 8' and 9' are bevelled and form, per inner or outer tooth, four channels 10', 11', 12', 13', extending linearly in longitudinal direction of the heat exchanger tube 4'. The profile 8' of the outer tube 2' has a rectangular cross section, while the profile 9' of the inner tube 3' in cross section has the shape of an isosceles, inverted trapezium.

A heat exchanger tube according to FIG. 1 or 2 can be manufactured by first providing the profiles 8, 9 or 8', 9' on the inner and outer tubes 2, 3 or 2', 3', followed by screwing or sliding the inner tube 3 or 3' into the outer tube 2 or 2'. After that, the assembled tubes are deformed in a drawing process through cold deformation so that the individual tube walls of the outer and inner tubes 2, 3 or 2' 3' are as it were compressed into one single tube wall. Because during the drawing process, the outer diameter of the outer tube 2 or 2' is reduced and/or the inner diameter of the inner tube 3 or 3' is increased, for instance by means of a drawing die, the assembly is deformed to become a heat exchanger tube reacting as a one-piece conduit.

It is readily understood that within the framework of the invention as laid down in the appended claims still many other modifications and variants are possible. For instance, the profiles may also have different shapes, such as for instance a longitudinally extending T-section. Also, grooves may be provided in the side portions of the profiles or in the facing surfaces of the inner and outer tubes, which grooves constitute the longitudinal channels for a leak detection.

What is claimed is:

1. A method of manufacturing a heat exchanger tube for transferring heat from a first flowing medium to a second flowing medium, the method comprising the steps of:

providing an inner tube having a first pre-defined profile and an outer tube having a second pre-defined profile, substantially complementary to said first pre-defined profile;

joining said tubes by inserting said inner tube into said outer tube; and applying a cold deformation drawing process to said joined tubes to effect a change in diameter of said inner tube and said outer tube, whereby an outer wall of said inner tube is unilaterally clamped against an inner wall of said outer tube forming a longitudinally extending channel therebetween for leak detection.

2. The method in accordance with claim 1 wherein said outer tube has an inner diameter and said inner diameter is reduced by said drawing process.

3. The method in accordance with claim 1 wherein said inner tube has an outer diameter and said outer diameter is increased by said drawing process.

4. The method in accordance with claim 1 wherein said inner tube and said outer tube are each provided with corresponding screw thread-shaped profiles and wherein said inner tube and said outer tube are joined by screwing said inner tube into said outer tube.

5. The method in accordance with claim 1 and further comprising the steps of providing each of said inner tube and said outer tube with corresponding longitudinally extending profiles and wherein said heat exchanger tube is assembled by sliding said inner tube into said outer tube.

6. A heat exchanger tube for transferring heat from a flowing medium to another flowing medium, said heat exchanger tube comprising:

a metal outer tube and a metal inner tube, said outer tube and said inner tube having facing surfaces provided with complementary profiles, said facing surfaces being disposed in rigid abutment to form a longitudinally extending channel for leak detection between said outer tube and said inner tube such that at least parts of said complementary profiles are in undercut engagement and such that a shrinking of said inner tube relative to said outer tube causes said parts of said profiles disposed in undercut engagement to be drawn together more firmly.

7. A heat exchanger tube in accordance with claim 6 wherein said profile of said inner tube has a rounded free edge portion.

8. The heat exchanger tube in accordance with claim 6 wherein said inner tube has an outer having a beveled free edge portion.

9. The heat exchanger tube in accordance with claim 6 wherein said inner tube has an outer profile having a continuously widening shape widening in a direction extending toward a free end.

10. The heat exchanger tube in accordance with claim 9 wherein said outer tube has a predefined cross section profile shaped in the form of an inverted isosceles trapezium.

11. The heat exchanger tube in accordance with claim 9 wherein said inner tube has a pre-defined cross-section profile shaped in the form of an inverted isosceles trapezium.

12. The heat exchanger tube in accordance with claim 6 wherein said profiles of said outer tube and of said inner tube are each formed in a screw-thread shape and said inner and outer tubes are shaped to engage each other as a screw thread.

13. The heat exchanger in accordance with claim 6 wherein said complimentary profiles comprise longitudinally extending ribs and said profiles of said inner and outer tubes are adapted to engage each other as longitudinal teeth.

14. A heat exchanger tube for transferring heat from a flowing medium to another flowing medium, said heat exchanger tube comprising:

a metal outer tube and a metal inner tube, said tubes having facing surfaces provided with complementary profiles, said facing surfaces being disposed in rigid abutment to form a longitudinally extending channel for leak detection between said outer tube and said inner tube and disposed such that at least parts of said profiles are in undercut engagement and such that an expansion of said outer tube relative to said inner tube causes said parts of said profiles disposed in undercut engagement to be drawn together more firmly.

15. The heat exchanger tube in accordance with claim 14 wherein said outer tube has an inner profile having a rounded free edge portion.

16. The heat exchanger tube in accordance with claim 14 wherein said outer tube has an inner profile having a beveled free edge portion.

* * * * *

UNITED STATES PATENT AND TRADEMARK OFFICE

CERTIFICATE OF CORRECTION

PATENT NO. : 6,192,583
DATED : February 27, 2001
INVENTOR(S) : ROFFELSEN, Franciscus It is certified that error appears in the above-identified patent and that said Letters Patent is hereby corrected as shown below:

Col. 4, claim 8, line 29 after the word "outer" please insert the word "profile".

Signed and Sealed this

Fifth Day of June, 2001

Nicholas P. Godici

*Attest:*

NICHOLAS P. GODICI

*Attesting Officer*

*Acting Director of the United States Patent and Trademark Office*